US012006696B2

(12) United States Patent
Sharayko et al.

(10) Patent No.: US 12,006,696 B2
(45) Date of Patent: Jun. 11, 2024

(54) REINFORCEMENT RESTRAINT CHANNEL FOR A FAÇADE PANEL

(71) Applicant: Shildan, Inc., Mount Laurel, NJ (US)

(72) Inventors: Matthew James Sharayko, Harleysville, PA (US); Todd J. Petrillo, Levittown, PA (US); Moshe Steinmetz, Mount Laurel, NJ (US)

(73) Assignee: Shildan, Inc., Mount Laurel, NJ (US)

( * ) Notice: Subject to any disclaimer, the term of this patent is extended or adjusted under 35 U.S.C. 154(b) by 94 days.

(21) Appl. No.: 17/763,466

(22) PCT Filed: Sep. 23, 2020

(86) PCT No.: PCT/US2020/052169

§ 371 (c)(1),
(2) Date: Mar. 24, 2022

(87) PCT Pub. No.: WO2021/061740

PCT Pub. Date: Apr. 1, 2021

(65) Prior Publication Data

US 2022/0341183 A1 Oct. 27, 2022

Related U.S. Application Data

(60) Provisional application No. 62/946,653, filed on Dec. 11, 2019, provisional application No. 62/905,529, filed on Sep. 25, 2019.

(51) Int. Cl.
*E04F 13/08* (2006.01)
*E04F 13/14* (2006.01)

(52) U.S. Cl.
CPC ..... *E04F 13/0825* (2013.01); *E04F 13/142* (2013.01)

(58) Field of Classification Search
CPC ..... E04F 13/0825; E04F 13/142
See application file for complete search history.

(56) References Cited

U.S. PATENT DOCUMENTS

| | | | | |
|---|---|---|---|---|
| 5,013,083 | A * | 5/1991 | Yada | F16B 5/128 296/213 |
| 7,726,083 | B2 | 6/2010 | Wagner | |
| 10,900,238 | B2 * | 1/2021 | Lehmann | E04F 13/083 |
| 2008/0010922 | A1 | 1/2008 | Wagner | |
| 2013/0160393 | A1 | 6/2013 | Steinmetz | |
| 2018/0209154 | A1 | 7/2018 | Ausseur et al. | |

FOREIGN PATENT DOCUMENTS

| | | | |
|---|---|---|---|
| DE | 3641747 | A1 | 6/1988 |
| EP | 2940229 | A2 | 11/2015 |

* cited by examiner

*Primary Examiner* — Patrick J Maestri
(74) *Attorney, Agent, or Firm* — Dilworth & Barrese, LLP

(57) ABSTRACT

A reinforcing restraint channel that is inserted in and clipped to a terracotta/ceramic panel, improves mechanical safety of the terracotta/ceramic facade in case of catastrophic failure such as severe breaking, cracking, or penetration that would normally result in large chunks of terracotta/ceramic falling off the façade, and posing a severe safety risk. Disengagement and falling of terracotta/ceramic chunks from the façade is minimized when the reinforcing restraint channel is inserted into core holes in the terracotta/ceramic panels forming the façade. A clip is also provided to secure the reinforcing restraint channel in place with the terracotta/ceramic panel.

7 Claims, 17 Drawing Sheets

REINFORCEMENT RESTRAINT CHANNEL FOR A FAÇADE PANEL

BACKGROUND OF THE INVENTION

The present invention is directed to improving supplemental reinforcing and restraint of extruded terracotta/ceramic rainscreen panels where deemed necessary due to building design and/or code requirements. More particularly, the present invention improves reinforcement restraint of terracotta/ceramic panels against breakage and/or disengagement in a simple, facilitated and effective manner, minimizes damage and/or falling pieces of terracotta/ceramic panel(s) that are damaged as a result of an impact by another object or other cause for damage to the installed terracotta/ceramic panel(s).

Terracotta/ceramic panels used as a rainscreen building façade system are manufactured with a series of core holes. However, terracotta/ceramic, as many building façade materials, can be prone to damage upon impact by objects (flying and/or suspended, etc.) such as window washing equipment, construction equipment or other foreign objects). In the event of a strong impact, the terracotta/ceramic façade panels may experience catastrophic breakage/failure, resulting in the possibility of pieces of the broken terracotta/ceramic panel falling from the building structure.

U.S. Pat. No. 7,726,083 to Wagner is directed to, among other features, improving hanging of extruded terracotta/ceramic façade on underlying support structure, and facilitating removal should any of the façade panels be damaged. However, the problem of catastrophic failure and breakage of such terracotta/ceramic façade panels still remain.

It has now been found, however, such terracotta/ceramic panels can be easily reinforced against breakage and catastrophic failure, in simple, uncomplicated manner, and remain easily removed and replaced should it be necessary.

SUMMARY OF THE INVENTION

Accordingly, it is an object of the invention to improve safety and durability of terracotta/ceramic façade against undue breakage and separation.

It is a more detailed object of the invention to facilitate additional restraint and reinforcing of terracotta/ceramic façade panels in smooth and uncomplicated manner.

It is also an object of the present invention to conserve material and energy in reinforcing and restraint of terracotta/ceramic façade panels against breakage.

These and other objects are attained by the present invention which is directed to a reinforcement restraint channel for a terracotta/ceramic panel, substantially in the shape of a multifaceted C or U and configured to snugly fit within and extend along a core hole in a terracotta/ceramic panel and reinforce the same. The reinforcement restraint channel is sufficiently strong and durable to prevent separation and falling of pieces of the terracotta/ceramic panel in event of catastrophic breakage, cracking or penetration. The reinforcement restraint channel is made from metal, preferably aluminum, or another composite material which is both sufficiently lightweight to easily handle and at the same time, effectively reinforces the terracotta/ceramic panel when inserted in the core hole. A single or several reinforcement restraint channels each snugly fit within and extend along a respective core hole(s) in the terracotta/ceramic panel.

A resilient compression spring-like clip retains each reinforcing restraint channel within the respective core hole(s), and is made of resilient material, preferably stainless steel, aluminum or other composite material. The clip is formed into two components, a first component having two sides joined at an acute angle with respect to one another, forming a V-shaped compression spring, and a second component in a C or U shape and fitting within and seating against inner sides of the C or U-shaped reinforcement restraint channel, when installed therein.

The present invention effectively buttresses the reinforced terracotta/ceramic panel against undue breakage and/or restrains broken segments of the panel upon catastrophic impact by foreign objects, and is both easy to install and remove, if necessary.

BRIEF DESCRIPTION OF THE DRAWINGS

The present invention will be described in greater detail with reference to the accompanying drawings, in which.

DESCRIPTION OF THE PREFERRED EMBODIMENTS

Figures 1, 2, 3, 4, 5:
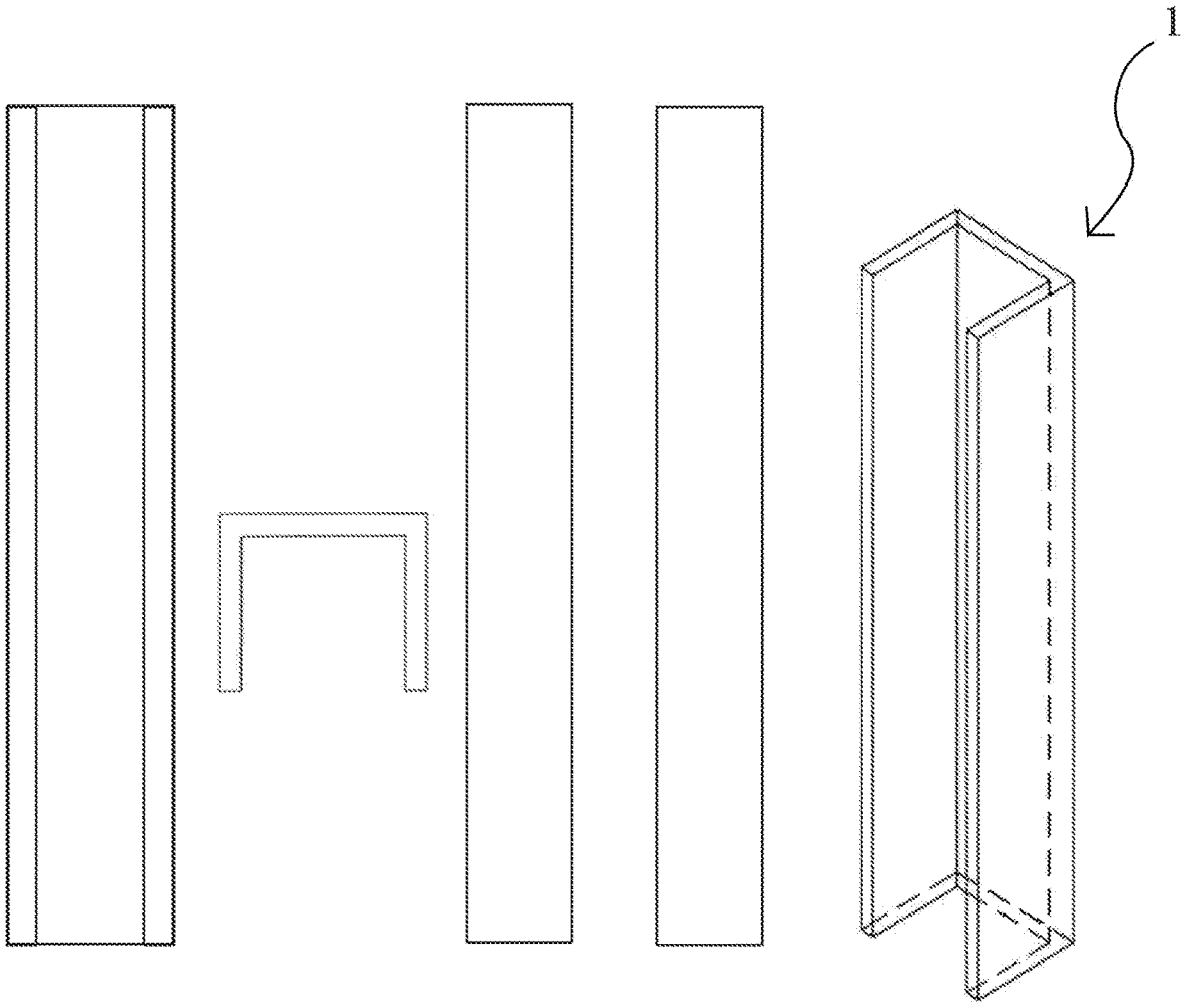
FIG. 1 illustrates a perspective view of the C-shaped or U-shaped reinforcing restraint channel of the present invention.
FIG. 2 illustrates a side elevational view of the C-shaped or U-shaped reinforcing restraint channel (the opposite side elevational view being a mirror image thereof)
FIG. 3 illustrates a front elevational view of the C-shaped or U-shaped reinforcing restraint channel.
FIG. 4 illustrates a rear elevational view of the C-shaped or U-shaped reinforcing restraint panel.
FIG. 5 illustrates a top plan view of the C-shaped or U-shaped reinforcing restraint panel (the bottom plan view being a mirror image thereof)
Figure 9:
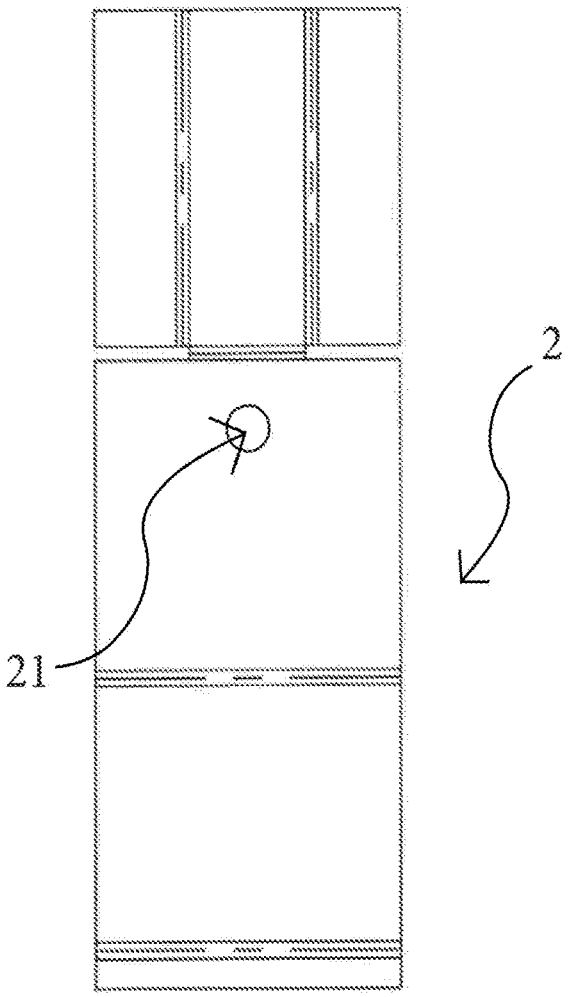
FIG. 9 illustrates an unfolded plan view of the components forming the clip prior to bending and folding the components with respect to one another.
Figure 7:
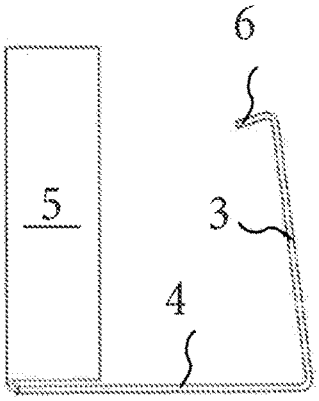
FIG. 7 illustrates a side elevational view of the components forming the clip (the opposite side elevational view being a mirror image thereof)
Figure 6:
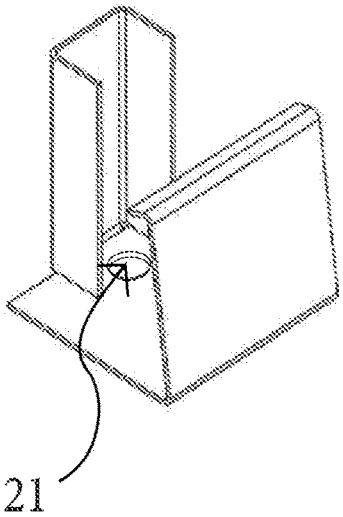
FIG. 6 illustrates a perspective view of a first embodiment of the clip for securing the C-shaped or U-shaped reinforcing channel of the present invention in a terracotta/ceramic panel, in which the two separate components forming the clip are integral.
Figure 8:
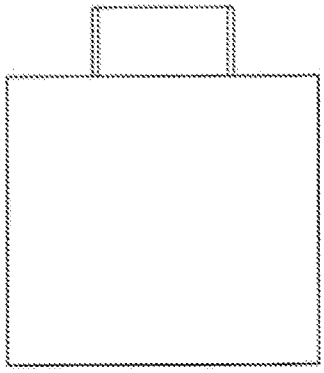
FIG. 8 illustrates a front elevational view of the components forming the clip supporting the reinforcing restraint channel.
Figure 13:
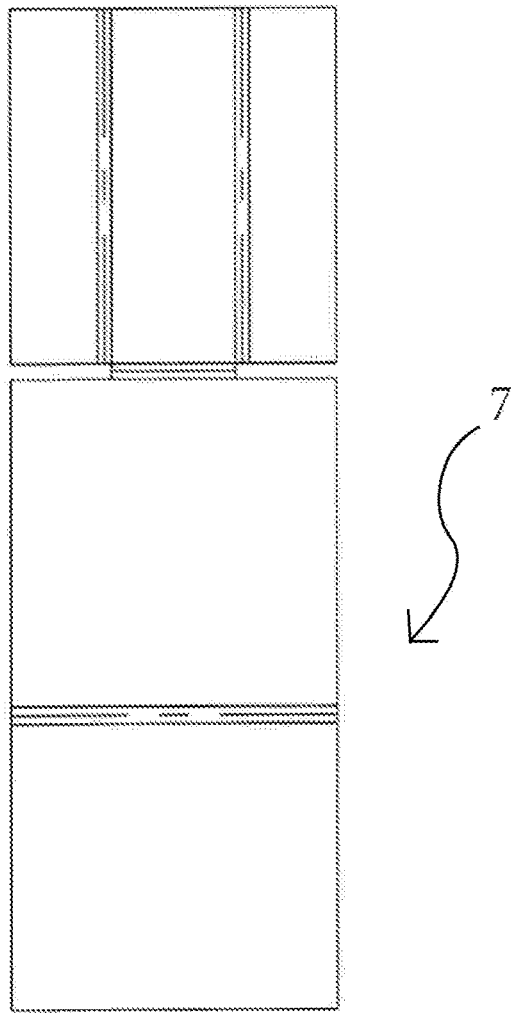
FIG. 13 illustrates an unfolded plan view of this variant of the clip prior to bending and folding the components with respect to one another.
Figure 11:
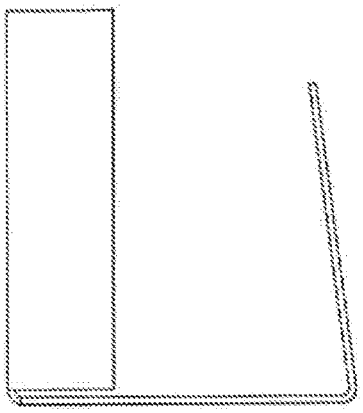
FIG. 11 illustrates a side elevational view of this variant of the clip supporting the reinforcing restraint channel (the opposite side elevational view being a mirror image thereof)
Figure 10:
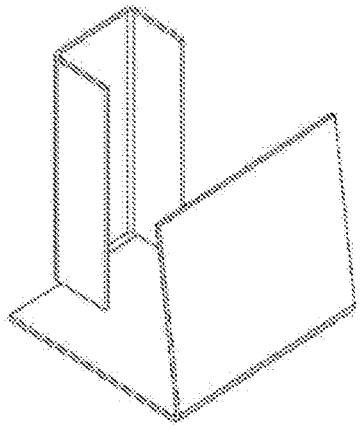
FIG. 10 illustrates a perspective view of a variant of the clip for securing the C-shaped or U-shaped reinforcing restraint channel of the present invention in a terracotta/ceramic panel.
Figure 12:
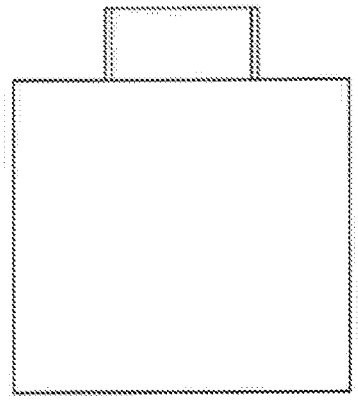
FIG. 12 illustrates a front elevational view of this variant of the clip supporting the reinforcing restraint channel.

As illustrated in the accompanying drawings, notably FIGS. 1-5, the reinforcing restraint channel 1 of the present invention is substantially in the shape of a C or U, i.e., is three-sided, with a fourth side being open as illustrated. Adjacent sides of the reinforcing restraint channel meet at sharp angles, forming a multifaceted C or U shape. Tips of the multifaceted C or U point to each other along the open side of the channel 1, as illustrated. Thus, the reinforcing restraint channel 1 snugly fits within and extends along a core hole in the terracotta/ceramic panel upon insertion and reinforces the terracotta/ceramic panel. The reinforcing restraint channel 1 can also be a closed square or rectangle, or a round shape.

More particularly, the reinforcement restraint channel 1 is sufficiently strong and durable to prevent separation and falling of pieces of the terracotta/ceramic panel should breaking, cracking or penetration occur, e.g., upon traumatic or catastrophic impact. In this regard, the reinforcement restraint channel 1 is made from metal, preferably aluminum, stainless steel or other composite material. Several such reinforcement restraint channels 1 each snugly fit within and extend along a respective core hole, upon insertion into the terracotta/ceramic panel. The reinforcing restraint channel 1 is held in place within the respective core hole by being coupled to a resilient clip 2, and is securely held in place in either horizontally-oriented or vertically oriented terracotta/ceramic panels.

For example, FIGS. 6-9 illustrate a clip 2 provided with a drainage hole 21 and designed to be coupled to and retain the reinforcing restraint channel 1 in place in a vertically-oriented terracotta/ceramic panel. The clip 2 is made of resilient material, preferably stainless steel or other composite material, and comprises two components, a first component having two sides 3,4 joined at an acute angle with respect to one another, forming a V-shaped compression spring, and a second component 5 in a C or U shape and configured to fit within and seat against inner sides of the C or U-shaped reinforcement restraint channel 1. As shown in the drawings, an end of the first component of the clip 2 has a tail 6 bent toward the other side of the clip 2.

The first V-shaped resilient component of the clip 2 is designed to retain the second C or U-shaped component 5 of the clip within the reinforcing restraint channel 1, and in turn, secure the reinforcement restraint channel 1 in place within a core hole of a vertically-oriented terracotta/ceramic panel. As shown in FIGS. 10-13, the variant of the first component of the clip 7 is essentially of the same construction as the first component of the clip 2 shown in FIGS. 6-9, but omits a drainage hole and a tail at the end of the first component of the clip 7 as illustrated (the second separate C or U-shaped component of the clip is identical). The clip 7 is designed to secure the reinforcement restraint channel 1 in a horizontally-oriented terracotta/ceramic panel core hole.

Figure 14:
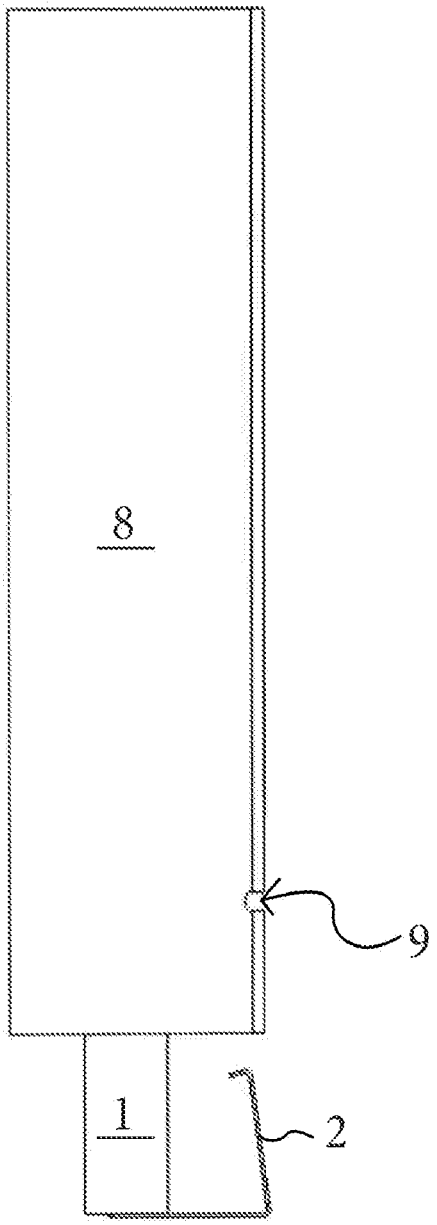
FIG. 14 schematically illustrates inserting the combination of the C-shaped or U-shaped reinforcing restraint channel and the clip coupled thereto, into a vertically-oriented terracotta/ceramic panel.
Figure 15:
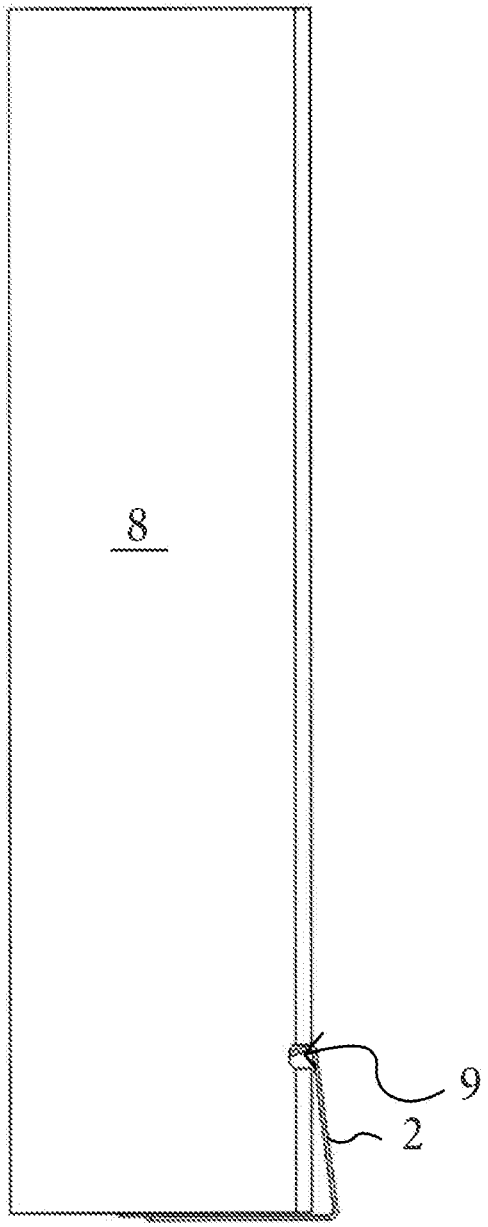
FIG. 15 schematically illustrates securing the clip on an outer surface of the vertically-oriented terracotta/ceramic panel.

Installation of the reinforcing restraint channel in the respective vertically or horizontally-oriented terracotta/ceramic panel is shown in FIGS. 14-17. More particularly, as illustrated in FIGS. 14 and 15, the second component 5 the resilient clip 2 is inserted into the reinforcing restraint channel 1, and then the reinforcing restraint channel 1 is slid into the appropriate core hole in the terracotta/ceramic panel 8. After the reinforcing restraint channel 1 and accompanying second component 5 of the clip 2 are slid into the core hole a sufficient distance, e.g., as far as possible, then the tail 6 at the end of the first component of the resilient clip 2 snaps into the notch 9 along the outer surface of the terracotta/ceramic panel 8 as illustrated in FIG. 15. The reinforcing restraint channel 1 will then be securely held in place within the core hole of the terracotta/ceramic panel 8 by the both components of the resilient clip 2.

Since the first component of the resilient clip 2 forms a compression spring, i.e., the sides 3,4 of the first component of the clip 2 are normally biased towards each other around the V-shaped angle, the reinforcing restraint channel 1 can be removed from within the core hole by simply biasing the side and tail 6 seated in the notch 9 outwardly, with the reinforcing restraint channel 1 and accompanying second component 5 of the clip 2 then easily slid out from within the terracotta/ceramic panel 8.

Figure 16:
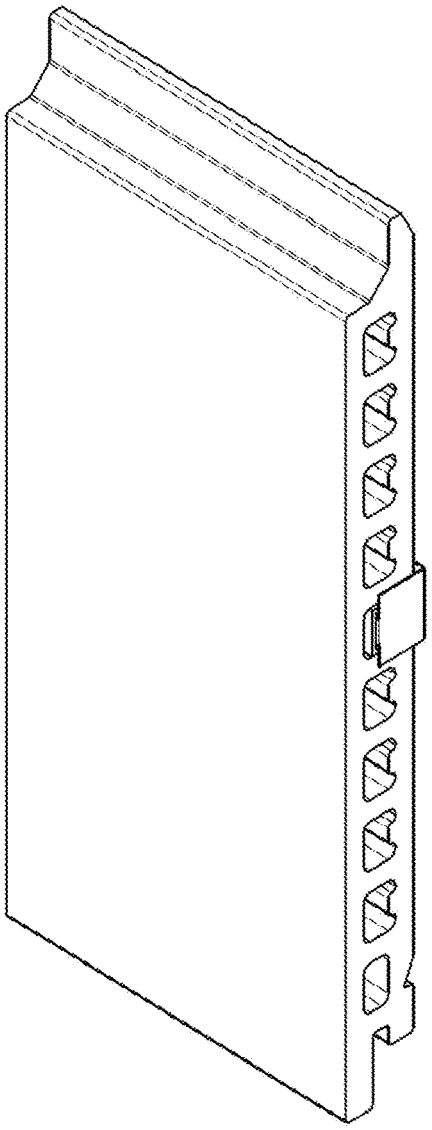
FIG. 16 schematically illustrates the secured reinforcing restraint channel in the horizontally-oriented terracotta/ceramic panel.
Figure 17:
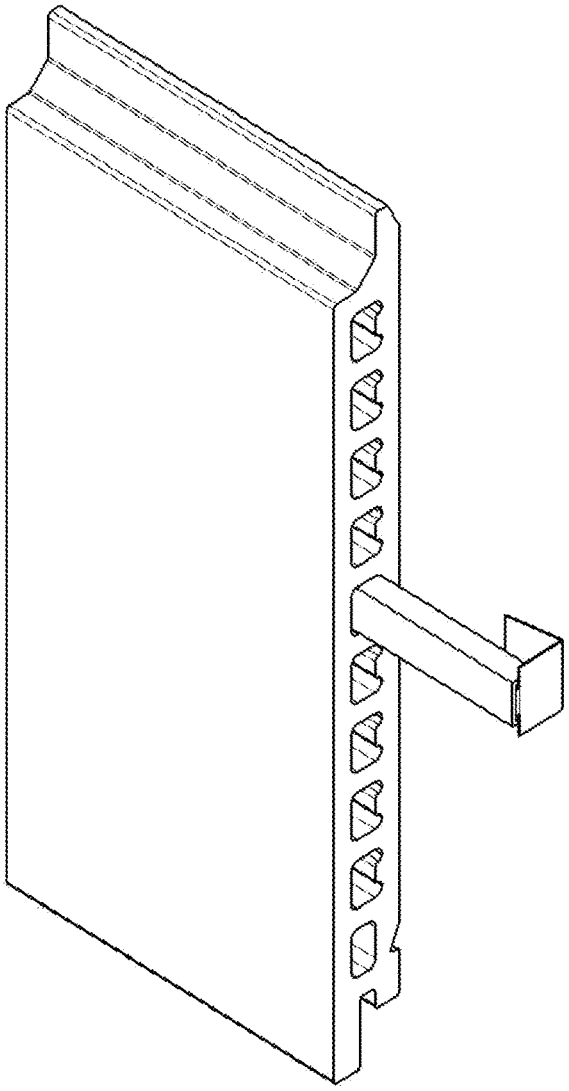
FIG. 17 schematically illustrates inserting the combination of the C-shaped or U-shaped reinforcing restraint channel and the clip coupled thereto, into the horizontally-oriented terracotta/ceramic panel.
Figure 18:
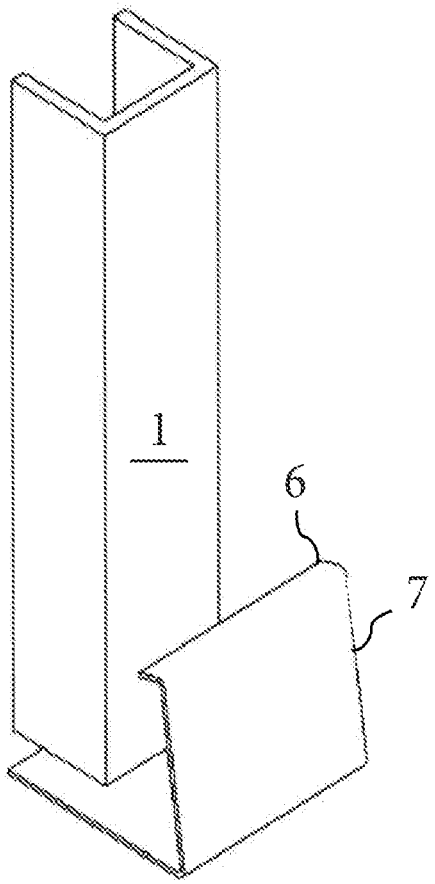
FIG. 18 illustrates an alternative orientation of coupling the clip to the reinforcing restraint channel for securing to the terracotta/ceramic panel.

In the embodiment illustrated in FIGS. 16-18, the reinforcing restraint channel 1 and clip 7 are horizontally slid into the core hole of the terracotta/ceramic panel 8, with the side of the first component of the resilient clip 7 omitting the tail simply resting against the vertical side of the horizontally-oriented terracotta/ceramic panel 8. In this arrangement of the horizontally-oriented terracotta/ceramic panel 8, there is no danger of the reinforcing restraint channel 1 inadvertently sliding out of the respective core hole due to gravity, so there is no need for a tail to be situated at the end of the first V-shaped component of the clip 7, allowing for conserving material and manufacturing effort and expenses in producing the clip. In this regard, the C-shaped or U-shaped reinforcing restraint channel can be oriented with the open side facing away from the clip 7 as shown in FIG. 18.

Figure 21:
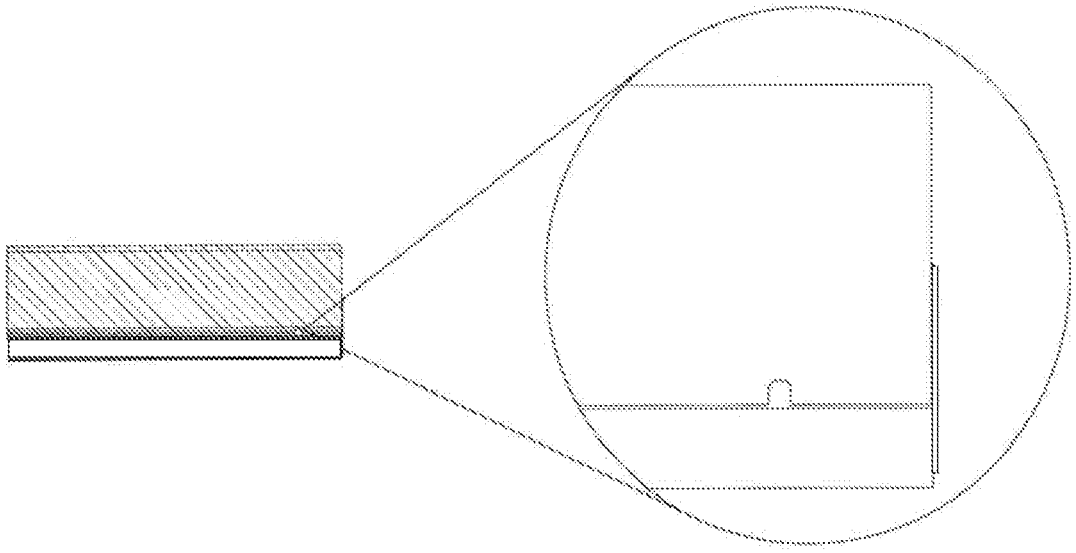
FIG. 21 illustrates a right side elevational view of the securing illustrated in FIGS. 19 and 20, and with an enlarged portion explicitly illustrating coupling the reinforcing restraint channel to the vertically-oriented terracotta/ceramic panel by the clip.
Figure 19:
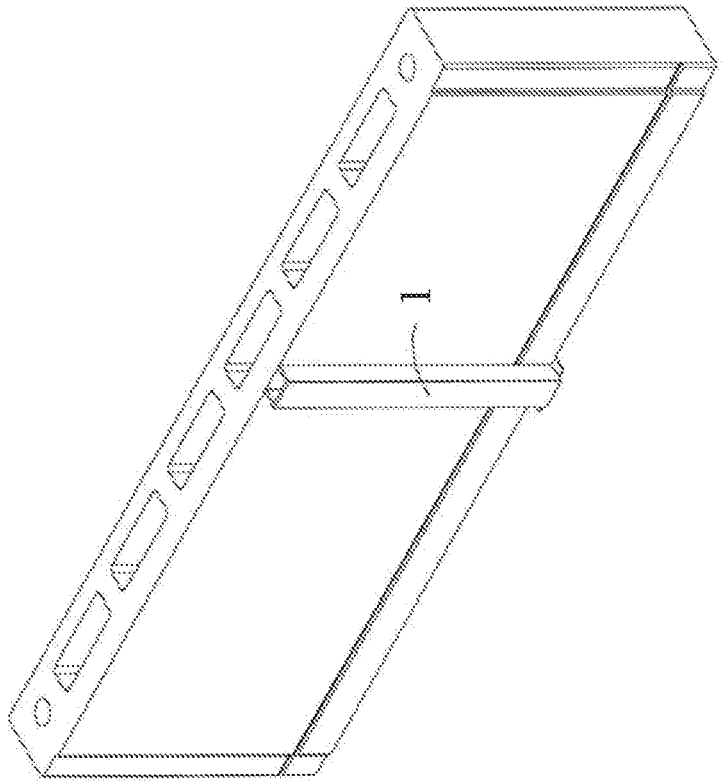
FIG. 19 illustrates a perspective view of an alternative manner of securing the reinforcing restraint panel to the outside of a vertically-oriented terracotta/ceramic panel.
Figure 20:
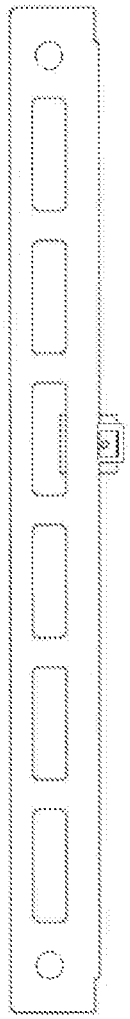
FIG. 20 illustrates a top plan view of the securing illustrated in FIG. 19.
Figure 22:
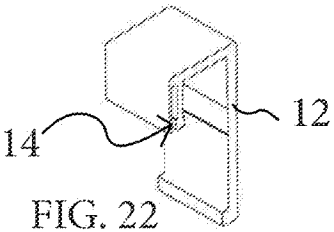
FIG. 22 illustrates a perspective view of a retaining clip for securing the top of the vertically-oriented terracotta/ceramic panel to a wall structure.
Figure 24:
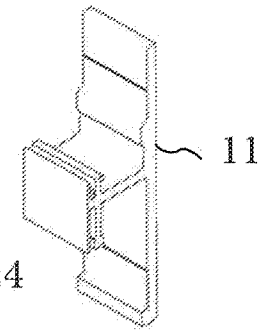
FIG. 24 illustrates a perspective view of a retaining clip for securing separate, vertically-oriented terracotta/ceramic panels to one another and to the wall structure.
Figure 26:
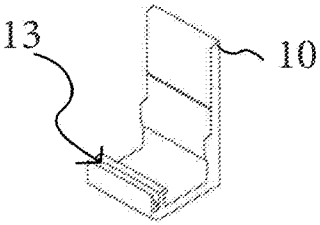
FIG. 26 illustrates a perspective view of a retaining clip for securing the bottom of a vertically-oriented terracotta/ceramic panel to a wall structure.
Figure 23:
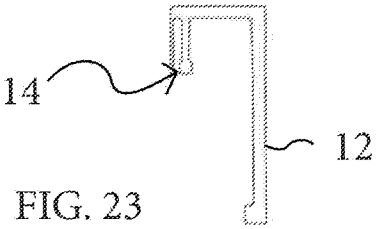
FIG. 23 illustrates a side elevational view of the retaining clip illustrated in FIG. 22.
Figure 25:
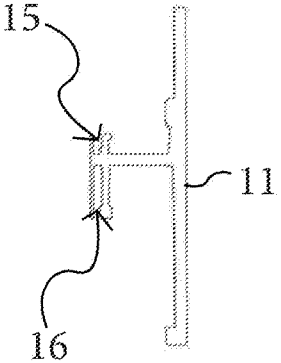
FIG. 25 illustrates a side elevational view of the retaining clip illustrated in FIG. 24.
Figure 27:
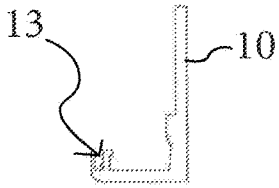
FIG. 27 illustrates a side elevational view of the retaining clip illustrated in FIG. 26.
Figure 28:
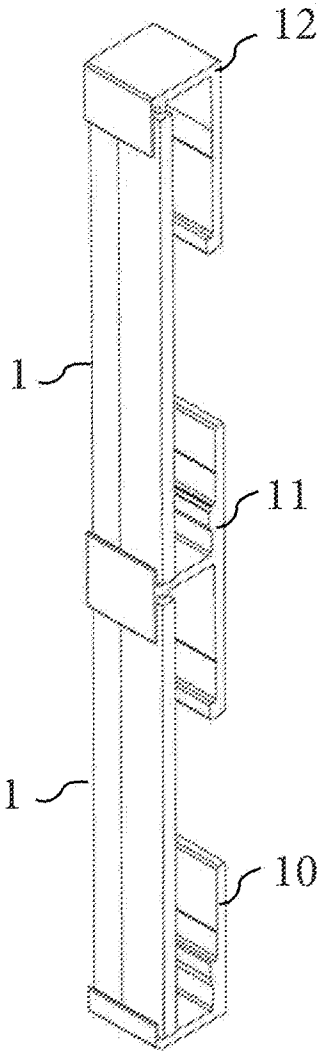
FIG. 28 illustrates a perspective view of coupling vertically-oriented reinforcing restraint channels on top of one another with the retaining clips illustrated in FIGS. 22-27.
Figure 29:
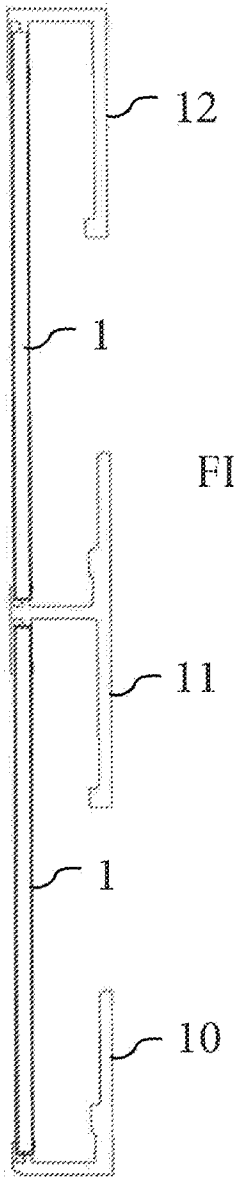
FIG. 29 illustrates a side elevational view of the coupling illustrated in FIG. 28.
Figure 32:
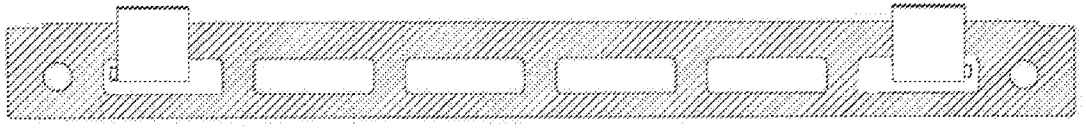
FIG. 32 illustrates a top plan view of FIGS. 31 and 32.
Figure 31:
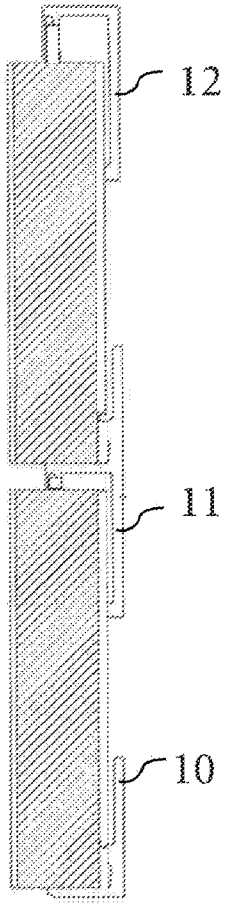
FIG. 31 illustrates a side elevational view of FIG. 30.
Figure 30:
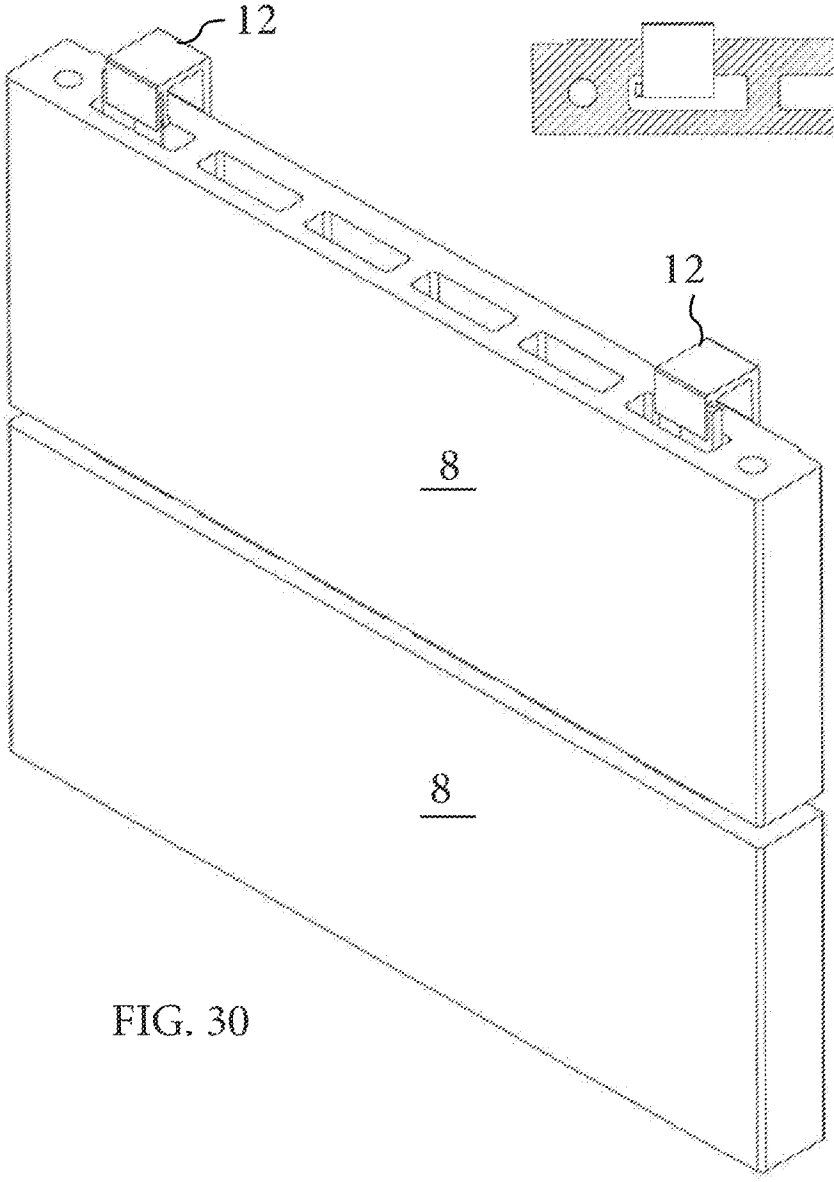
FIG. 30 illustrates a perspective view of coupling vertically-oriented reinforcing restraint channels to one another within the vertically-oriented terracotta/ceramic panels and with the retaining clips illustrated in FIGS. 22-27.

As illustrated in FIGS. 19-21, it is also possible to secure the reinforcing restraint channel 1 to the exterior of the vertically-oriented terracotta/ceramic panel 8, with the clip 2 at the bottom thereof. More particularly, it is also possible to vertically secure reinforcing restraint channels 1 and terracotta/ceramic panels 8 on top of one another as shown in FIGS. 29-31, with the retaining clips illustrated in FIGS. 22-27 and designed to couple the terracotta/ceramic panels 8 to one another and to a wall structure. The lowermost clip 10 and uppermost clip 12 each have projections defining respective notches 13 and 14 for receiving edges of the reinforcing restraint channel 1, while the intermediate clip 11 is also provided with projections defining notches 15, 16 for receiving edges of the respective reinforcing restraint channels 1. Secure coupling of the reinforcing restraint panels 1 to one another within the vertically-oriented terracotta/ceramic panels 1 is illustrated in FIGS. 30-31.

Figure 35:
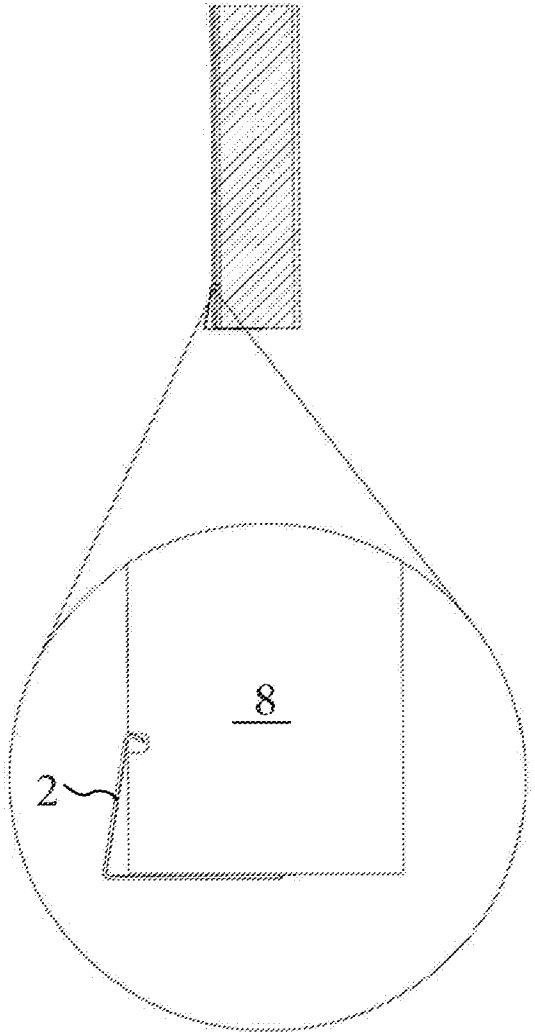
FIG. 35 illustrates a right side elevational view of the securing illustrated in FIGS. 33 and 34, and with an enlarged portion explicitly illustrating coupling the reinforcing restraint channel to the vertically-oriented terracotta/ceramic panel by the clip.
Figure 33:
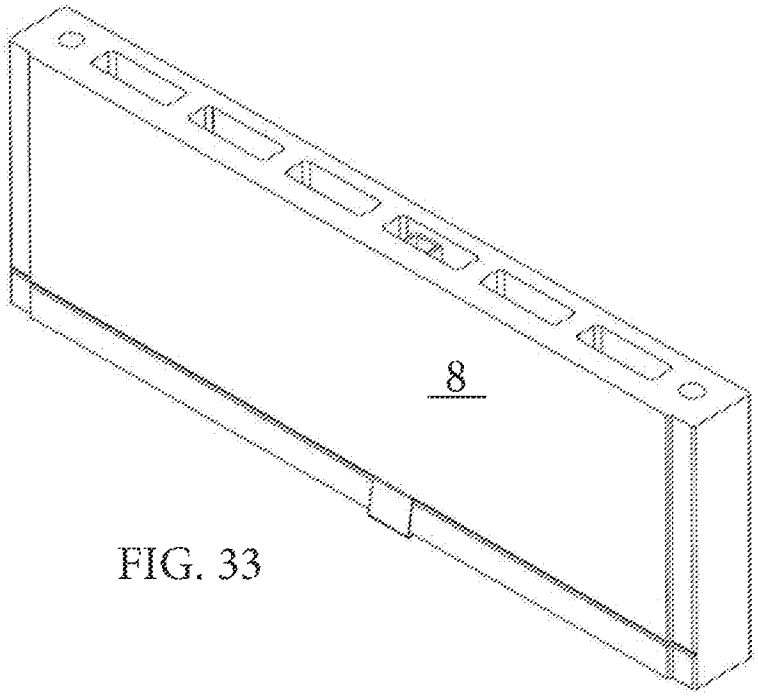
FIG. 33 illustrates a perspective view of securing the reinforcing restraint panel within a vertically-oriented terracotta/ceramic panel by the clip.
Figure 34:
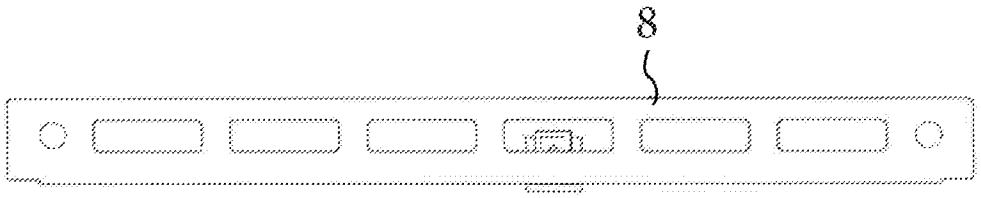
FIG. 34 illustrates a top plan view of the securing illustrated in FIG. 33.
Figure 38:
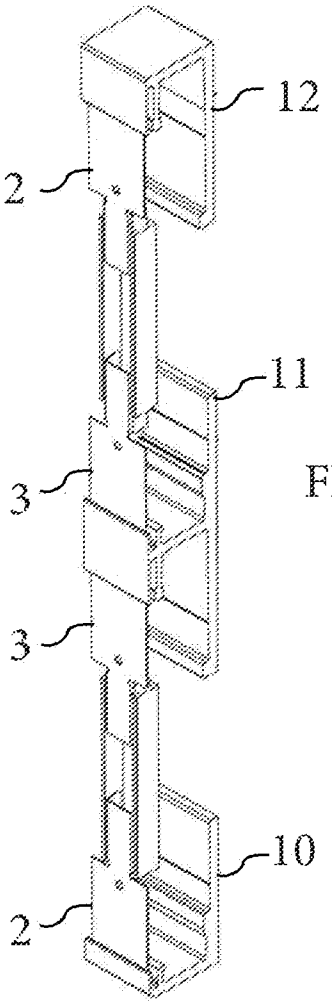
FIG. 38 illustrates a perspective view of coupling vertically-oriented reinforcing restraint channels on top of one another with the clip illustrated in FIGS. 36 and 37 and with the retaining clips of FIGS. 22-27.
Figure 39:
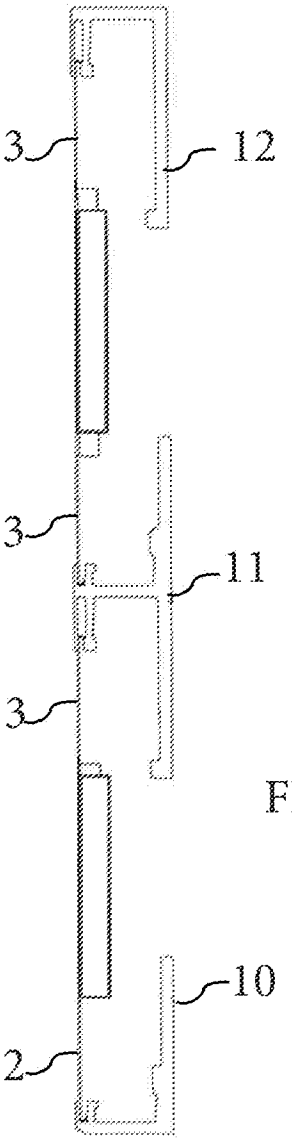
FIG. 39 illustrates a side elevational view of FIG. 38.
Figure 42:
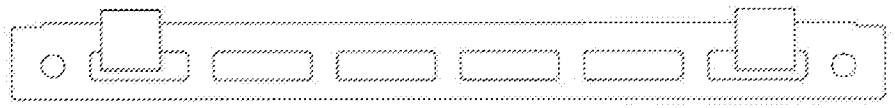
FIG. 42 illustrates a top plan view of FIGS. 41 and 42.
Figure 41:
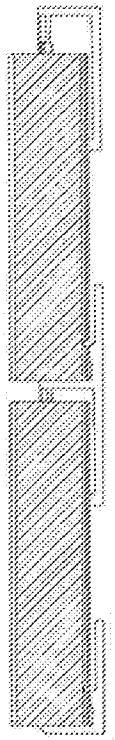
FIG. 41 illustrates a side elevational view of FIG. 40.
Figure 40:
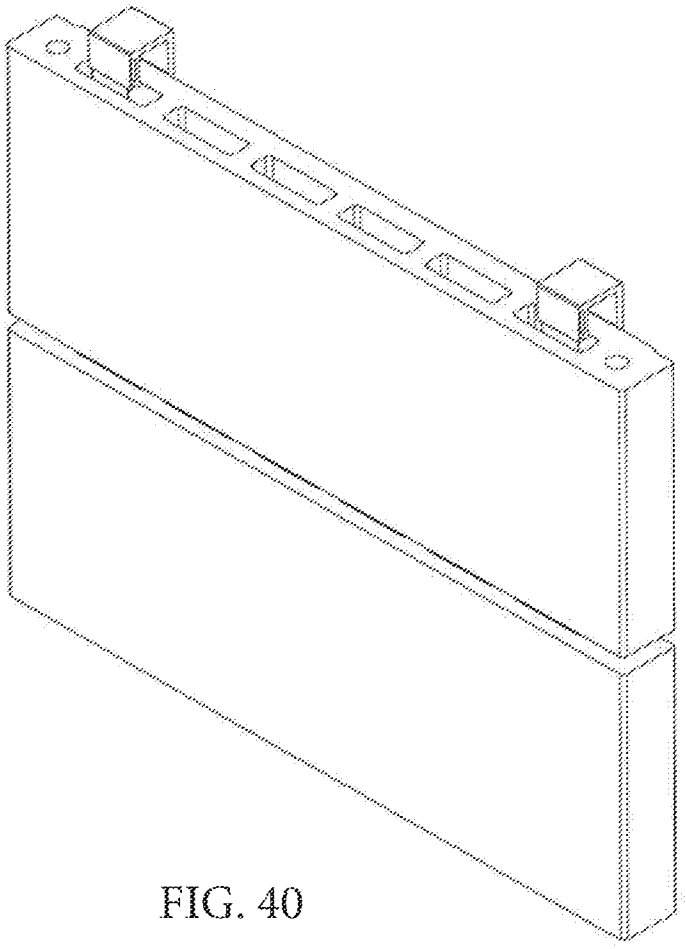
FIG. 40 illustrates a perspective view of coupling vertically-oriented reinforcing restraint channels to one another within the vertically-oriented terracotta/ceramic panels and with the clip illustrated in FIGS. 38 and 39 and retaining clips of FIGS. 22-27.

FIGS. 33-35 illustrate coupling of the reinforcing restraint panels 1 within the respective vertically-oriented terracotta/ceramic panels 8, in accordance with FIGS. 14 and 15. FIGS. 38 and 39 illustrate vertically coupling reinforcing restraint panels 1 on top of one another with the unbent clips 2 and terracotta/ceramic panel retaining clips 10-12 respectively illustrated in FIGS. 6-9 and 22-27, with FIGS. 40-42 illustrating vertically coupling of one terracotta/ceramic panel 8 on top of the other.

Figure 37:
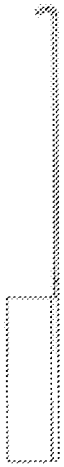
FIG. 37 illustrates a side elevational view of FIG. 36.
Figure 36:
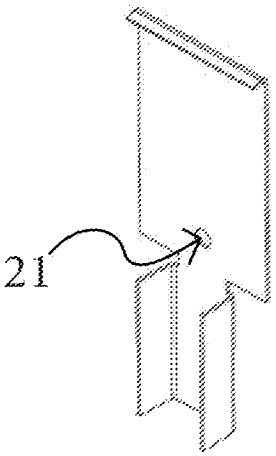
FIG. 36 illustrates a perspective view of a further alternative embodiment of a clip for securing the reinforcing restraint channel.

FIGS. 36 and 37 respectively illustrate views of the clip 2 with tail 6 at one end, and having different width of the second component 5 upon folding to accommodate a reinforcing restraint channel 1 of different width. This clip 2 is easier to snap into place in the assembly illustrated, e.g., in FIGS. 38 and 39, where the C-shaped channel 1 is secured in place with the clip 2 of FIGS. 36 and 37 seating in the respective notches in the retaining clips for the terracotta/ceramic panels shown in FIGS. 22-27.

Figure 44:
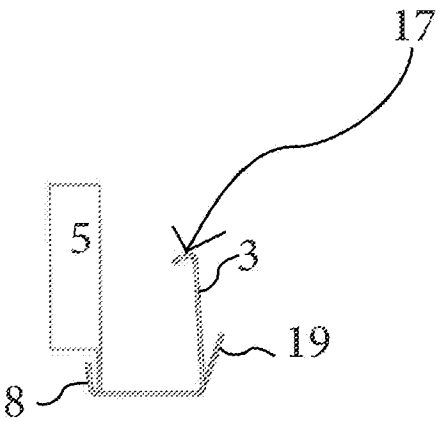
FIG. 44 illustrates a side elevational view of the clip illustrated in FIG. 43.
Figure 43:
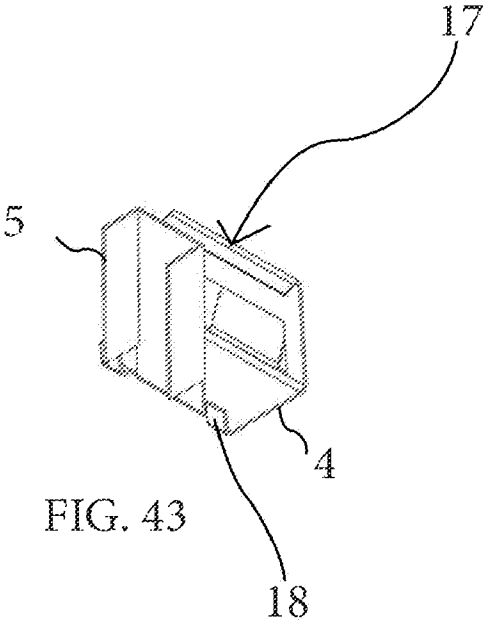
FIG. 43 illustrates a perspective view of a further alternative embodiment of a clip for securing to the reinforcing restraint channel.
Figure 46:
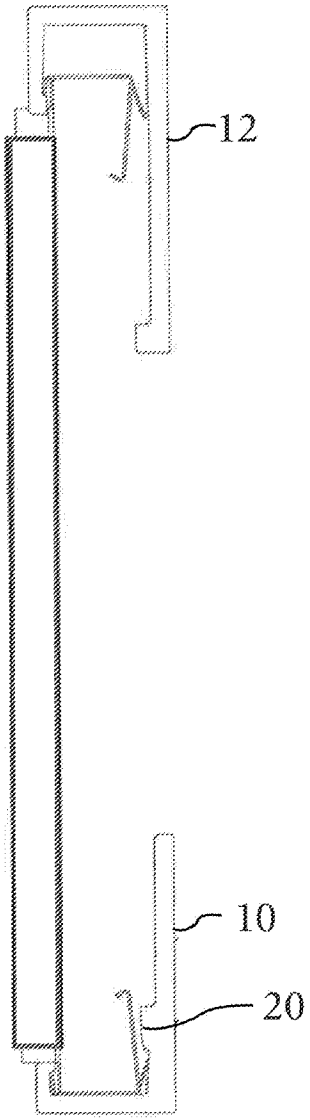
FIG. 46 illustrates a side elevational view of FIG. 45.
Figure 45:
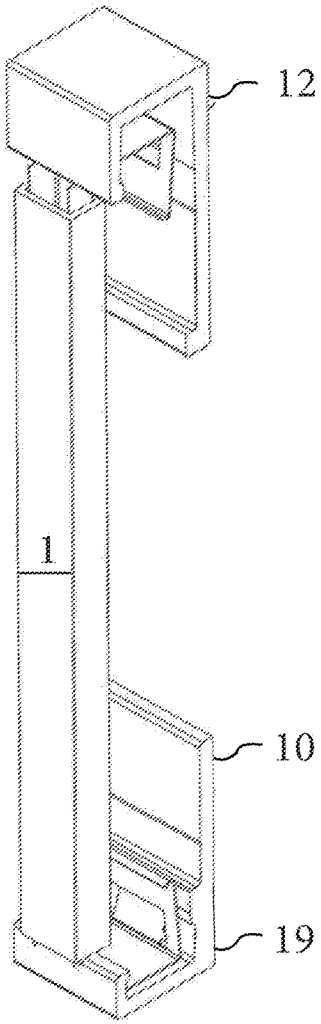
FIG. 45 illustrates a perspective view of a vertically-oriented reinforcing restraint channel secured to the clips illustrated in FIGS. 43, 44 and FIGS. 26 and 27.
Figure 51:
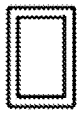
FIG. 51 illustrates a top plan view of the reinforcing restraint channel of FIGS. 47 and 50.
Figure 52:
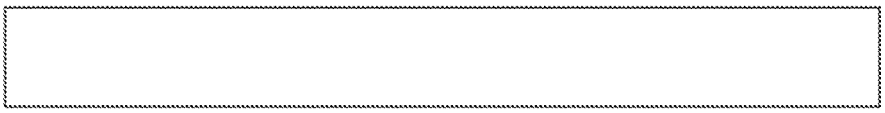
FIG. 52 illustrates a side elevational view of the reinforcing restraint channel of FIGS. 47, 50 and 51.

Another example of such clip 17 is shown in FIGS. 43 and 44, where the second component 5 is folded out of a wider side 4 of the first component, leaving a lateral tail 18 on either side thereof. The opposite side 3 of the first component also has a narrower tail 19 bent out therefrom. As shown in FIGS. 45 and 46, the second component 5 is easily accommodated in a smaller, narrower reinforcing restraint channel 1, while the tail 19 catches under ridge 20 in the lower clip 10 and a ridge in the upper clip 12. The reinforcing replacement channel 1 can therefore be mounted, e.g., on the exterior of the terracotta/ceramic panel 8 while the clip 17 is mounted inside the core hole of the respective terracotta/ceramic panel 8.

Figure 49:
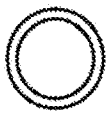
FIG. 49 illustrates a top plan view of the reinforcing restraint channel of FIG. 48.
Figure 50:
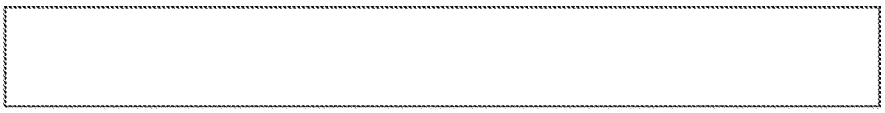
FIG. 50 illustrates a side elevational view of the reinforcing restraint channel of FIG. 47.
Figure 48:
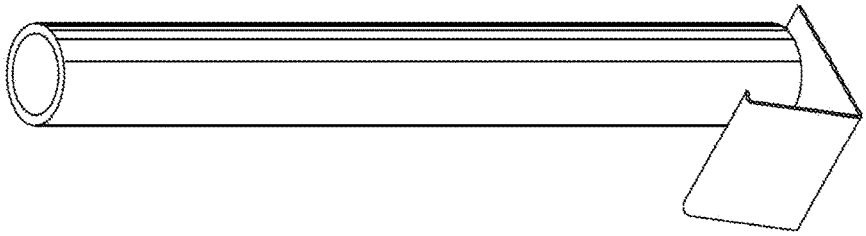
FIG. 48 illustrates a perspective view of a tubular, cylindrically-shaped reinforcing restraint channel situated on a bottom clip.
Figure 47:
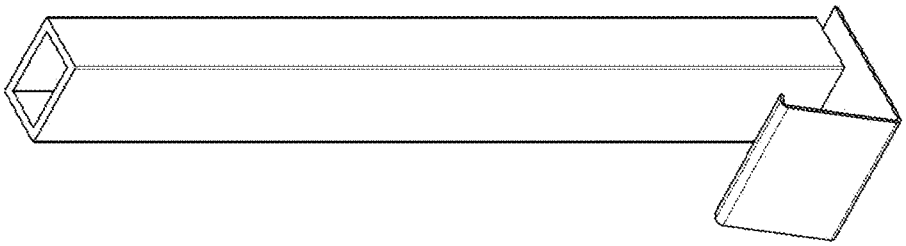
FIG. 47 illustrates a perspective view of a hollow, rectangular parallelepiped reinforcing restraint channel situated on a bottom clip.

While the various embodiments above illustrate the reinforcement restraint panel in the shape of a C or U, FIGS. 47 and 50-52 illustrate this reinforcing restraint channel alternative in the shape of a closed rectangular parallelepiped, and FIGS. 48 and 49 illustrate this reinforcing restraint channel in the shape of a cylindrical tube.

The preceding description of the present invention is merely exemplary, and not intended to limit the scope thereof in any way.

What is claimed is:

1. A combination of a reinforcement restraint channel for a terracotta/ceramic panel, said channel in substantially in the shape of a multifaceted C or U or a closed shape and configured to fit within and extend along a core hole in a terracotta/ceramic panel and reinforce the same, and a clip for holding the reinforcement restraint channel in place within the respective core hole upon insertion, wherein the clip is made of resilient material and comprises two separate components integrally connected with one another, a first component composed of two sides joined at an acute angle with respect to one another, forming a V-shaped compression spring, and a second component configured to fold or bend out from the first component, and fit within and seat against inner sides of the reinforcement restraint channel.

2. The combination of claim 1, wherein one side of the first component of the clip has a tail bent toward the other side of the first component of the clip.

3. A clip for securing a reinforcement restraint channel in a core hole of a terracotta/ceramic panel, wherein the clip is made of resilient material and comprises two separate components integrally connected, a first component composed of two sides joined at an acute angle with respect to one another and forming a V-shaped compression spring, and a second component in a C or U shape directly connected to one of said two sides forming the V-shaped acute angle, and folded or bent out from said one side of the first component.

4. The clip of claim 3, wherein the clip is made of stainless steel, aluminum or other composite material.

5. The clip of claim 3, wherein said other side of the first component of the clip has a tail bent toward said one side of the first component of the clip.

6. A combination of a reinforcement restraint channel for a terracotta/ceramic panel, said channel in substantially in the shape of a multifaceted C or U or a closed shape or a flat bar and configured to fit within and extend along a core hole in a terracotta/ceramic panel and reinforce the same, and a clip for holding the reinforcement restraint channel in place within the respective core hole upon insertion, additionally comprising clips for securing the terracotta/ceramic panels to one another, including a clip for seating on top of a terracotta/ceramic panel, a clip for seating on a bottom of a terracotta/ceramic panel, and a clip for interlocking adjacent terracotta/ceramic panels, wherein each said clip comprises at least one notch for receiving an edge of a respective reinforcing restraint channel.

7. A clip for securing a reinforcement restraint channel in a core hole of a terracotta/ceramic panel, wherein the clip is made of resilient material and comprises two separate components integrally connected, a first component composed of two sides joined at an acute angle with respect to one another, forming a V-shaped compression spring, a second component in a C or U shape and foldable or bendable out from a wider side of the first component, leaving a lateral tail on either side thereof along an edge of the wider side of the first component, the first component having a narrower tail bendable outwardly therefrom, and the second component being narrower than the wider side of the first component, such that sides of said C or U shape are inwardly spaced from lateral edges of the wider side of the first component, when the second component is folded or bent out from the wider side of the first component.

* * * * *